US010078990B2

(12) United States Patent
Jeon et al.

(10) Patent No.: US 10,078,990 B2
(45) Date of Patent: Sep. 18, 2018

(54) TIMING CONTROLLER AND DISPLAY DEVICE INCLUDING THE SAME

(71) Applicant: SAMSUNG DISPLAY CO., LTD., Yongin-si, Gyeonggi-do (KR)

(72) Inventors: Byungkil Jeon, Hwaseong-si (KR); Junpyo Lee, Asan-si (KR); Hwanwoong Lee, Asan-si (KR); Yongho Sung, Seongnam-si (KR); Woojung Jung, Cheonan-si (KR); Seunghwan Moon, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 282 days.

(21) Appl. No.: 15/014,862

(22) Filed: Feb. 3, 2016

(65) Prior Publication Data

US 2016/0284308 A1 Sep. 29, 2016

(30) Foreign Application Priority Data

Mar. 27, 2015 (KR) ..... 10-2015-0043528

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 2310/08* (2013.01); *G09G 2320/0285* (2013.01); *G09G 2320/064* (2013.01)

(58) Field of Classification Search
CPC combination set(s) only.
See application file for complete search history.

(56) References Cited

U.S. PATENT DOCUMENTS

2010/0328339 A1* 12/2010 Cho ..... G09G 3/3426 345/589

FOREIGN PATENT DOCUMENTS

| | | | |
|---|---|---|---|
| KR | 10-2012-0005916 | A | 1/2012 |
| KR | 10-1232086 | B1 | 2/2013 |
| KR | 10-2014-0033776 | A | 3/2014 |
| KR | 10-1415572 | B1 | 7/2014 |
| KR | 10-2014-0107936 | A | 9/2014 |
| KR | 10-1501481 | B1 | 3/2015 |

(Continued)

OTHER PUBLICATIONS

Korean Patent Abstracts of Korean Publication No. 1020120036477 A, Apr. 18, 2012, for Korean Patent No. 10-1232086 B1, Feb. 8, 2013, 1 Page.

(Continued)

*Primary Examiner* — Robin Mishler
(74) *Attorney, Agent, or Firm* — Lewis Roca Rothgerber Christie LLP

(57) ABSTRACT

A timing controller includes: a compensator to receive an image signal and to output a compensation image signal; a dimming range adjustor to receive a backlight dimming signal and to output a dimming range signal to adjust an active section of the backlight dimming signal; a smoothing processor to output a smoothing image signal to smooth the compensation image signal in response to the dimming range signal; and a data output part to output an image data signal by adding the smoothing image signal to the image signal.

16 Claims, 8 Drawing Sheets

(56) References Cited

FOREIGN PATENT DOCUMENTS

WO WO 2011/001720 A1 1/2011

OTHER PUBLICATIONS

Korean Patent Abstracts of Korean Publication No. 1020090052654 A, May 26, 2009, for Korean Patent No. 10-1415572 B1, Jul. 7, 2014, 1 Page.
Korean Patent Abstracts of Korean Publication No. 1020100075074 A, Jul. 2, 2010, for Korean Patent No. 10-1501481 B1, Mar. 30, 2015, 1 Page.

* cited by examiner

FIG. 7

215

| RGB | COMP_RGB |
|---|---|
| 0 | 0 |
| 16 | 16 X COMP1 |
| 32 | 32 X COMP2 |
| 64 | 64 X COMP3 |
| 128 | 128 X COMP4 |
| 192 | 192 X COMP5 |
| 256 | 256 X COMP6 |
| 384 | 384 X COMP7 |
| 512 | 512 X COMP8 |
| 784 | 784 X COMP9 |
| 880 | 880 X COMP10 |
| 1020 | 1020 |

TIMING CONTROLLER AND DISPLAY DEVICE INCLUDING THE SAME

CROSS-REFERENCE TO RELATED APPLICATION

This patent application claims priority to and the benefit of Korean Patent Application No. 10-2015-0043528 filed on Mar. 27, 2015, the entire content of which is hereby incorporated by reference.

BACKGROUND

As a user interface, a display device may be mounted on an electronic device, and in order to provide for a light weight, thin, short, and small electronic device having low power consumption, a flat display device is widely used as the display device.

Since a liquid crystal display (LCD), that is, the currently most popular flat display device, is a light receiving device that displays an image by adjusting the amount of light received from the outside, a backlight unit (BLU) including an additional light source for emitting light to a liquid crystal panel, that is, a backlight lamp, may be used. Recently, a light emitting diode (LED) having characteristics of low power consumption, eco-friendly, and slim design is extensively used as a light source.

Amorphous Silicon (a-Si) used for a thin film transistor (TFT) LCD is sensitive to light. That is, when irradiated with light, an a-Si thin film has a conductor property, and thus, its resistance is reduced, and when the light is removed, the a-Si thin film has a non-conductor property, and thus, its resistance becomes relatively larger, so that the a-Si thin film is affected by a charging voltage of a liquid crystal capacitor. Additionally, in some cases, when irradiated with light, the a-Si thin film causes an increase of parasitic capacitance, so that a screen noise phenomenon may be seen.

When the light of a backlight unit is emitted uniformly, since this affects the front surface of a liquid crystal panel evenly, there may be no problems. Suggested is a Pulse-Width Modulation (PWM) luminance adjustment method for turning on/off a backlight unit periodically in order to improve the image quality aspects.

In the PWM luminance adjustment method, if a ratio of a sync signal frequency and a PWM frequency is not identical or substantially identical, the movement of a regular band may be observed in each frame. This phenomenon is called waterfall noise.

The above information disclosed in this Background section is only for enhancement of understanding of the background of the invention and therefore it may contain information that does not form prior art.

SUMMARY

One or more aspects of embodiments of the present invention relate to a timing controller capable of improving an image quality displayed on a display panel.

One or more aspects of embodiments of the present invention relate to a display device including a timing controller capable of improving an image quality displayed on a display panel.

In an exemplary embodiment of the present invention, a timing controller includes: a compensator configured to receive an image signal and to output a compensation image signal; a dimming range adjustor configured to receive a backlight dimming signal and to output a dimming range signal to adjust an active section of the backlight dimming signal; a smoothing processor configured to output a smoothing image signal to smooth the compensation image signal in response to the dimming range signal; and a data output part configured to output an image data signal by adding the smoothing image signal to the image signal.

In one embodiment, the compensator may include a lookup table to store the compensation image signal corresponding to a grayscale value of the image signal.

In one embodiment, the image signal may correspond to one of G grayscale values; the lookup table may store H compensation image signals respectively corresponding to the G grayscale values of the image signal; and the compensator may be configured to interpolate the H compensation image signals to output the compensation image signal corresponding to the image signal (where G and H are positive integers, respectively (G>H)).

In one embodiment, the timing controller may further include a global dimming block configured to output a backlight control signal by delaying the backlight dimming signal by a time.

In one embodiment, the compensator may be configured to output the compensation image signal corresponding to the grayscale value of the image signal by referring to the lookup table, and to compensate the compensation image signal in response to a compensation level signal.

In one embodiment, the dimming range adjustor may be configured to output the dimming range signal by adjusting the active section of the backlight dimming signal in response to a rising delay setting signal and a falling delay setting signal.

In an exemplary embodiment of the present invention, a display device includes: a display panel including a plurality of pixels respectively connected to a plurality of gate lines and a plurality of data lines; a gate driver configured to drive the plurality of gate lines; a data driver configured to drive the plurality of data lines in response to an image data signal; a backlight configured to supply light to the display panel in response to a backlight control signal; and a timing controller configured to receive an image signal, a control signal, and a backlight dimming signal, and to provide the image data signal to the data driver and the backlight control signal to the backlight, wherein the timing controller is configured to provide the image data signal to the data driver by compensating the image signal received during an active section of the backlight control signal.

In one embodiment, the timing controller may be configured to provide the image data signal to the data driver by compensating the image signal received during a rising section and a falling section of the backlight control signal.

In one embodiment, the timing controller may include: a compensator configured to receive the image signal and to output a compensation image signal; and a data output part configured to output the image data signal by adding the compensation image signal to the image signal.

In one embodiment, the timing controller may include: a compensator configured to receive the image signal and to output a compensation image signal; a dimming range adjustor configured to receive the backlight dimming signal and to output a dimming range signal to adjust an active section of the backlight dimming signal; a smoothing processor configured to output a smoothing image signal to smooth the compensation image signal in response to the dimming range signal; and a data output part configured to output the image data signal by adding the smoothing image signal to the image signal.

In one embodiment, the compensator may include a lookup table to store the compensation image signal corresponding to a grayscale value of the image signal.

In one embodiment, the image signal may correspond to one of G grayscale values; the lookup table may store H compensation image signals respectively corresponding to the G grayscale values of the image signal; and the compensator may be configured to interpolate the H compensation image signals to output the compensation image signal corresponding to the image signal (where G and H are positive integers, respectively (G>H)).

In one embodiment, the timing controller may include a global dimming block configured to output the backlight control signal by delaying the backlight dimming signal by a time.

In one embodiment, the compensator may be configured to output the compensation image signal corresponding to the grayscale value of the image signal by referring to the lookup table, and to compensate the compensation image signal in response to a compensation level signal.

In one embodiment, the dimming range adjustor may be configured to output the dimming range signal by adjusting the active section of the backlight dimming signal in response to a rising delay setting signal and a falling delay setting signal.

In one embodiment, the smoothing processor may be configured to output the smoothing image signal by smoothing the compensation image signal during a rising section and a falling section of the dimming range signal in response to a smoothing section setting signal.

In one embodiment, the timing controller may further include a setting storage part configured to store the compensation level signal, the rising delay setting signal, the falling delay setting signal, and the smoothing section setting signal.

In one embodiment, the timing controller may further include a control signal processor configured to output a first control signal to drive the data driver and a second control signal to drive the gate driver in response to the control signal.

BRIEF DESCRIPTION OF THE FIGURES

The above and other aspects and features of the present invention will become apparent to those skilled in the art from the following detailed description of the exemplary embodiments with reference to the accompanying drawings. In the drawings:

FIG. 7 is a view illustrating a lookup table for the timing controller shown in FIG. 5.

DETAILED DESCRIPTION

Figure 1:
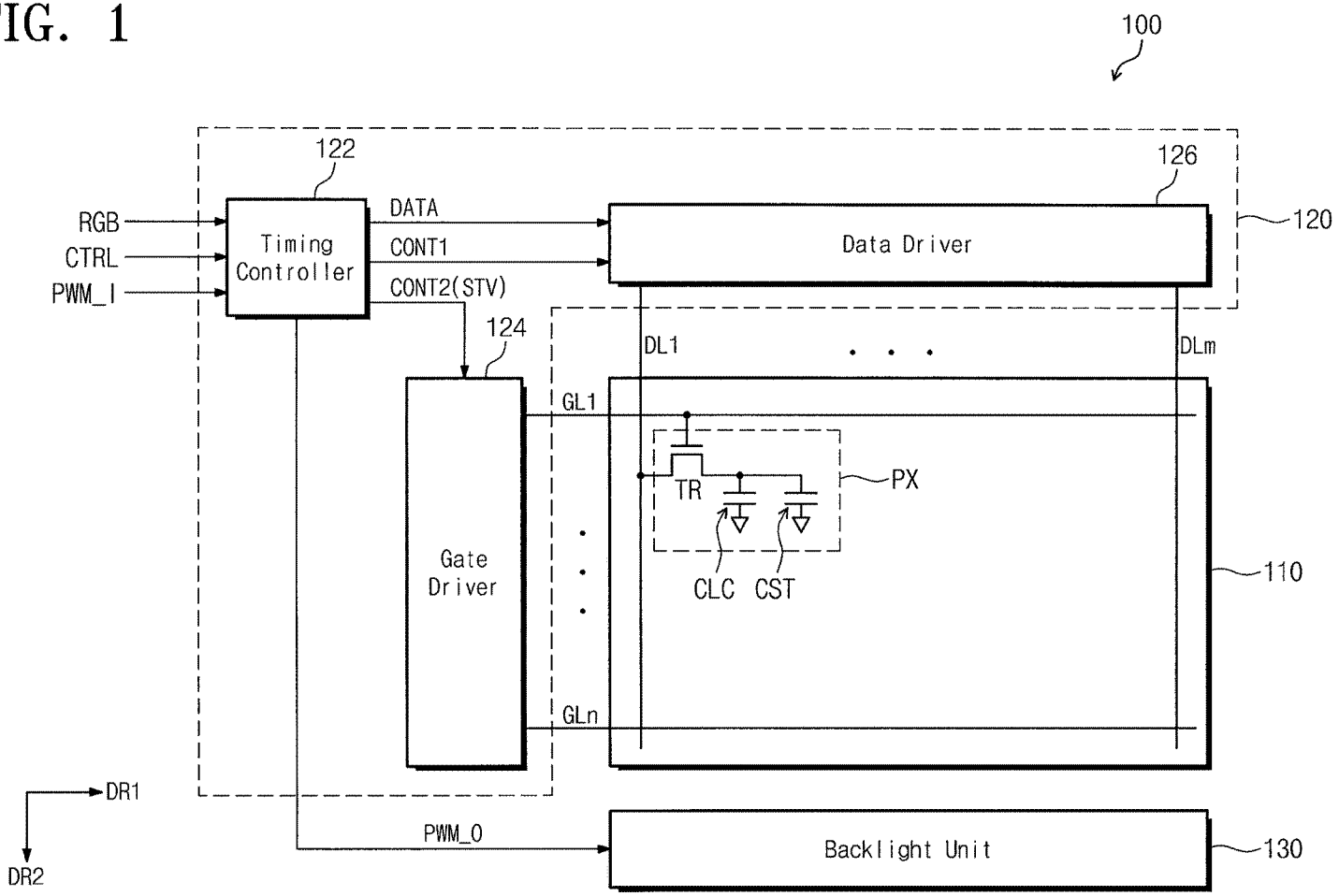
FIG. 1 is a block diagram illustrating a display device according to an exemplary embodiment of the invention.

Hereinafter, exemplary embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated.

Figure 2:
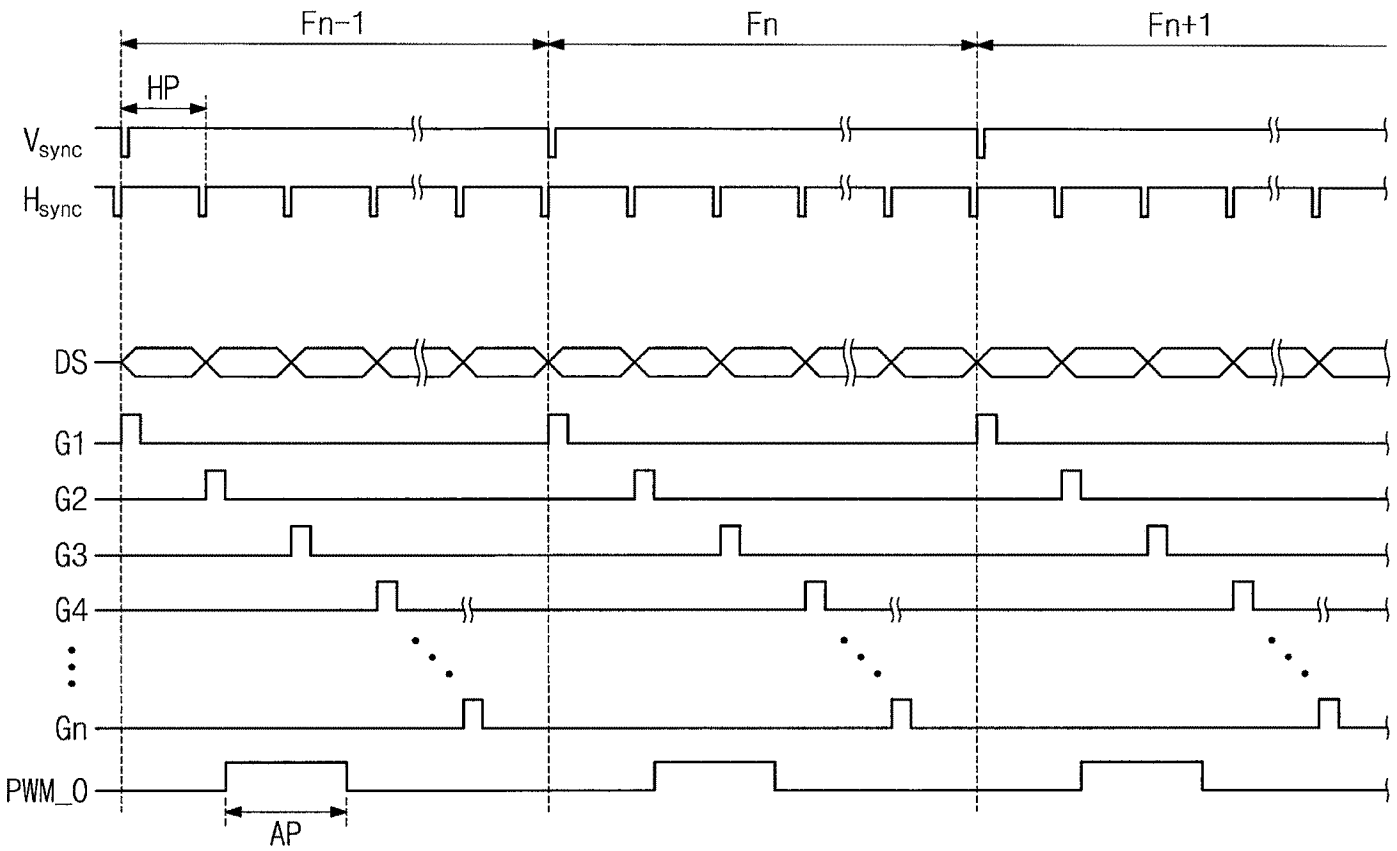
FIG. 2 is a timing diagram illustrating signals of a display device according to an exemplary embodiment of the invention.

FIG. 1 is a block diagram illustrating a display device according to an embodiment of the invention. FIG. 2 is a timing diagram illustrating signals of a display device according to an embodiment of the invention.

Referring to FIGS. 1 and 2, a display device 100 includes a display panel 110, a driving circuit 120, and a backlight unit (or backlight) 130.

The display panel 110 displays an image. In the present embodiment, although it is described as one example that the display panel 110 is a liquid crystal display panel, the display panel 110 may be a different kind of display panel that utilizes the backlight unit 130.

The display panel 110 includes a plurality of gate lines GL1 to GLn extending in a first direction DR1, a plurality of data lines DL1 to DLm extending in a second direction DR2, and a plurality of pixels PX arranged at crossing areas (regions) where the plurality of gate lines GL1 to GLn and the plurality of data lines DL1 to DLm cross each other. The data lines DL1 to DLm cross the gate lines GL1 to GLn and are insulated from the gate lines GL1 to GLn. Each of the pixels PX includes a thin film transistor TR, a liquid crystal capacitor CLC, and a storage capacitor CST.

Each of the pixels PX are formed of the same or substantially the same structure. Accordingly, as a configuration of one pixel is described, description of other ones of each of the pixels PX is omitted. The thin film transistor TR of the pixel PX includes a gate electrode connected to the first gate line GL1 from among the plurality of gate lines GL1 to GLn, a source electrode connected to the first data line DL1 from among the plurality of data lines DL1 to DLm, and a drain electrode connected to the liquid crystal capacitor CLC and the storage capacitor CST. One end of each of the liquid crystal capacitor CLC and the storage capacitor CST is connected in parallel to the drain electrode of the thin film transistor TR. The other end of each of the liquid crystal capacitor CLC and the storage capacitor CST is connected to a common voltage.

The driving circuit 120 includes a timing controller 122, a gate driver 124, and a data driver 126. The timing controller 122 receives an image signal RGB, control signals CTRL, and a backlight dimming signal PWM_I from the outside (e.g., external to the display device). The control signals CTRL, for example, include a vertical sync signal, a horizontal sync signal, a main clock signal, and a data enable signal. The timing controller 122 provides an image data signal DATA processed to correspond to an operation condition of the display panel 110 and a first control signal CONT1 to the data driver 126, and provides a second control signal CONT2 to the gate driver 124. The first control signal CONT1 may include a horizontal sync start signal, a clock signal, and a light latch signal, and the second control signal CONT2 may include a vertical synch start signal STV, an output enable signal, and a gate pulse signal. The timing controller 122 may change the image data signal DATA diversely according to the arrangement of the pixels PX in the display panel 110 and a display frequency, and may output the changed image data signal DATA. The timing controller 122 provides a backlight control signal PWM_O for controlling the backlight unit 130 to the backlight unit 130.

The gate driver 124 drives the gate lines GL1 to GLn in response to the second control signal CONT2 from the timing controller 122. The gate driver 124 includes a gate driving integrated circuit (IC). The gate driver 124 may be, for example, also implemented with a circuit using an oxide semiconductor, an amorphous semiconductor, a crystalline semiconductor, and/or a polycrystalline semiconductor.

The gate driver 124 generates gate signals G1 to Gn on the basis of the second control signal CONT2 received from the timing controller 122 during frame sections Fn−1, Fn, and Fn+1, and outputs the gate signals G1 to Gn to the plurality of gate lines GL1 to GLn, respectively. The gate signals G1 to Gn may be sequentially outputted in correspondence to horizontal sections HP.

The data driver 126 outputs data voltages DS for driving the data lines DL1 to DLm in response to the image data signal DATA and the first control signal CONT1 from the timing controller 122.

The data voltages DS may include positive data voltages having a positive value for a common voltage and/or negative data voltages having a negative value. Some of the data voltages DS applied to the data lines DL1 to DLm have a positive polarity and others have a negative polarity during each of the horizontal sections HP. The polarity of the data voltages DS may be inverted according to the frame sections Fn−1, Fn, and Fn+1 in order to prevent or reduce the deterioration of a liquid crystal. The data driver 126 may generate data voltages inverted by each frame section unit in response to an inversion signal.

The backlight unit 130 is disposed at the bottom part (e.g., back) of the display panel 110 to face the pixels PX. The backlight unit 130 operates in response to the backlight control signal PWM_O from the timing controller 122. The backlight control signal PWM_O includes at least one active section AP that is maintained at a high level during a predetermined or set time in one frame. During one frame, the backlight control signal PWM_O may include a plurality of active sections AP.

Figure 3A:
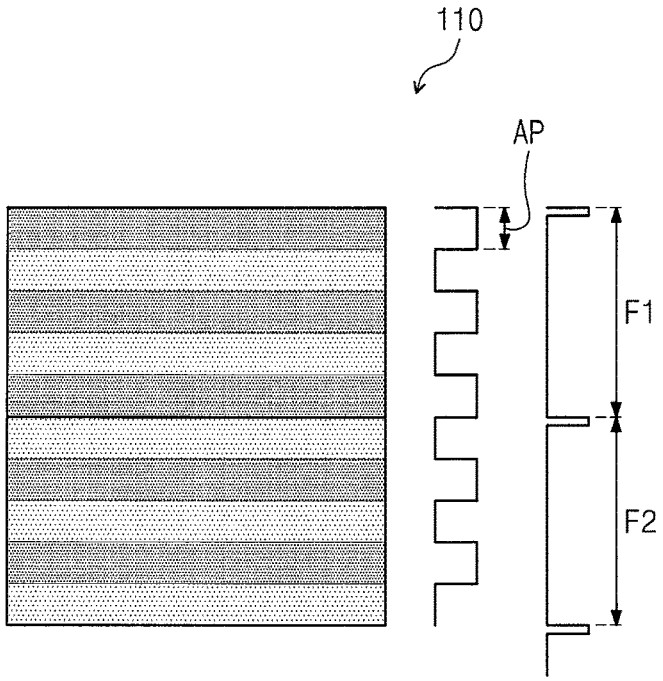
FIG. 3A is a view illustrating an image displayed on a display panel during two continuous frames according to a ratio of a backlight control signal and a sync signal.
Figure 3B:
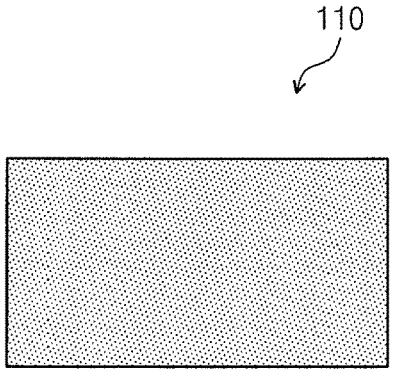
FIG. 3B is a view when an image shown in FIG. 3A is accumulatively displayed on a display panel.

FIG. 3A is a view illustrating an image displayed on a display panel during two continuous frames depending on a ratio of a backlight control signal and a sync signal according to an embodiment of the invention. FIG. 3B is a view when an image shown in FIG. 3A is accumulatively displayed on a display panel.

Referring to FIG. 3A, the backlight unit 130 shown in FIG. 1 emits light during an active section AP of the backlight control signal PWM_O. The luminance of an image displayed on the display panel during an active section AP of the backlight control signal PWM_O is different from that during a non-active section. Additionally, as shown in FIG. 3A, the position corresponding to an active section AP of the backlight control signal PWM_O in an image displayed on the display panel 110 during the first frame F1 is different from the position corresponding to an active section AP of the backlight control signal PWM_O in an image displayed on the display panel 110 during the second frame F2.

When a duty ratio of the backlight control signal PWM_O is about 50% and a frequency ratio of the vertical sync start signal STV and the backlight control signal PWM_O is appropriate, as shown in FIG. 3B, a luminance difference does not occur in an image displayed on the display panel 110.

Figure 4A:
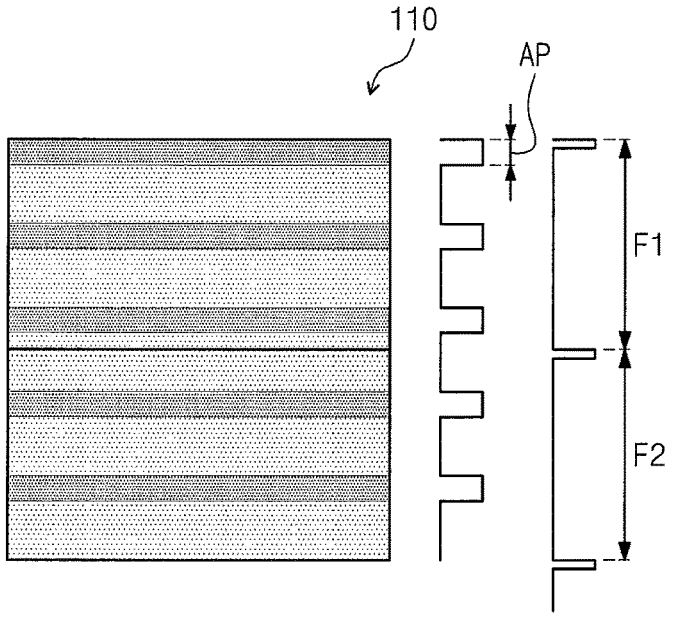
FIG. 4A is a view illustrating an image displayed on a display panel during two continuous frames depending on a ratio of a backlight control signal and a sync signal according to another exemplary embodiment of the invention.
Figure 4B:
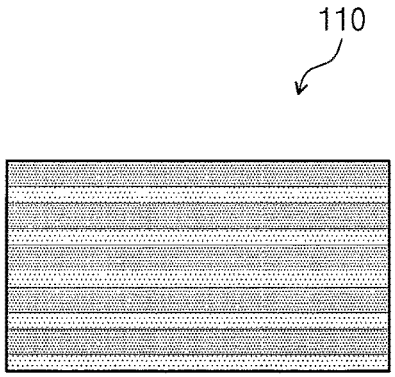
FIG. 4B is a view when an image shown in FIG. 4A is accumulatively displayed on a display panel.

FIG. 4A is a view illustrating an image displayed on a display panel during two continuous frames depending on a ratio of a backlight control signal and a sync signal according to another embodiment of the invention. FIG. 4B is a view when an image shown in FIG. 4A is accumulatively displayed on a display panel.

As shown in FIG. 4A, when a duty ratio of the backlight control signal PWM_O is less than about 50%, in each of the first frame F1 and the second frame F2, an area corresponding to an active section AP of the backlight control signal PWM_O is narrower than an area corresponding to a non-active section AP in an image displayed on the display panel 110. Additionally, the luminance of an image displayed on the display panel 110 during an active section AP of the backlight control signal PWM_O is different from that during a non-active section.

When an image of the first frame F1 and an image of the second frame F2 shown in FIG. 4A are sequentially displayed on one display panel 110, as shown in FIG. 4B, a regular movement of a band may be observed from an image displayed on the display panel 110, and this phenomenon is called waterfall noise.

Figure 5:
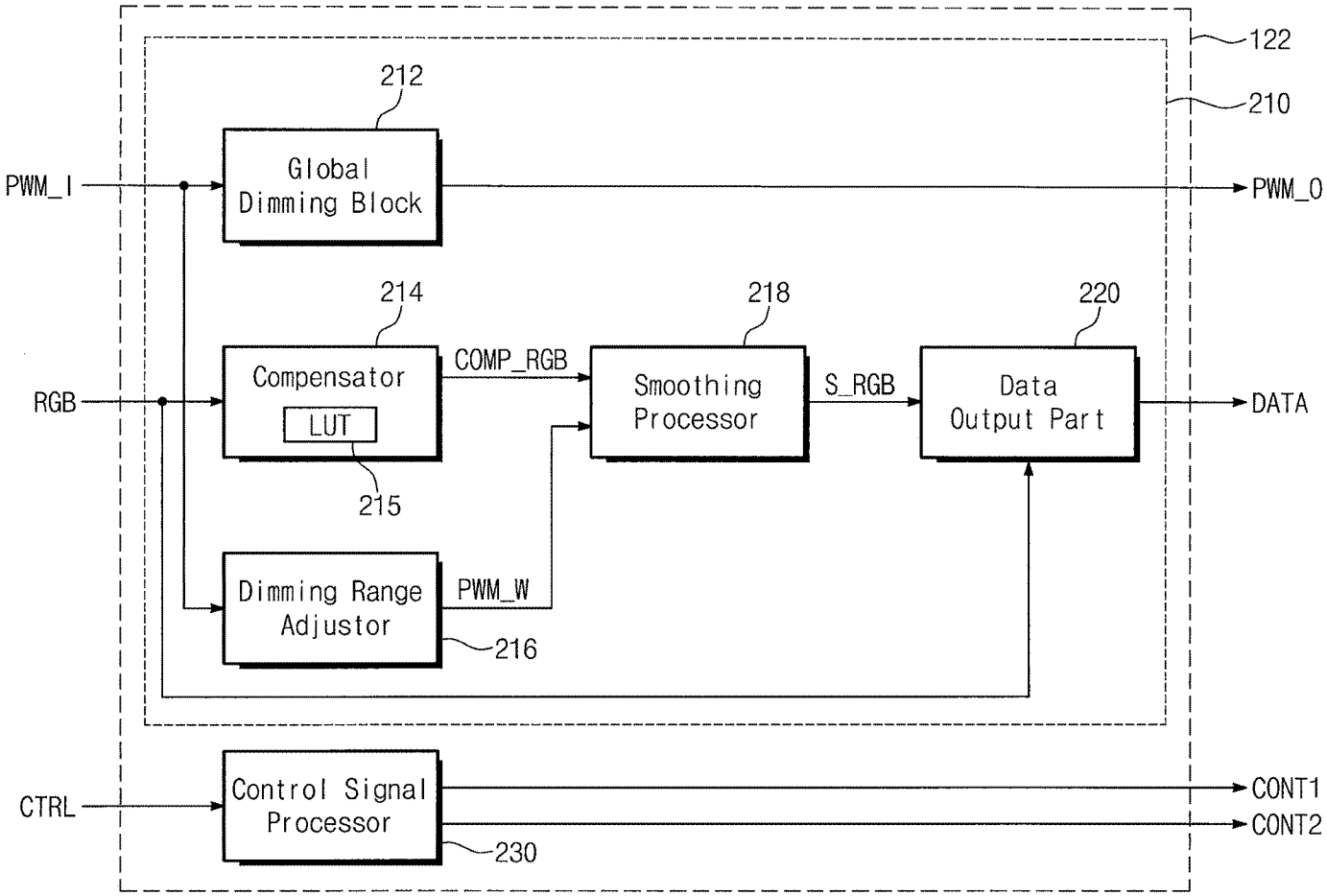
FIG. 5 is a block diagram illustrating a configuration of a timing controller shown in FIG. 1.

FIG. 5 is a block diagram illustrating a configuration of a timing controller shown in FIG. 1.

Referring to FIG. 5, the timing controller 122 includes a backlight control part 210 and a control signal processor 230. The backlight control part 210 includes a global dimming block 212, a compensator 214, a dimming range adjustor 216, a smoothing processor 218, and a data output part 220.

The global dimming block 212 receives a backlight dimming signal PWM_I provided from the outside, and outputs the backlight control signal PWM_O. The backlight control signal PWM_O may have the same or substantially the same pulse width as that of the backlight dimming signal PWM_I, and may be a signal for delaying the backlight dimming signal PWM_I by a predetermined or set time.

The compensator 214 receives an image signal RGB and outputs a compensation image signal COMP_RGB. The dimming range adjustor 216 receives a backlight dimming signal PWM_I and outputs a dimming range signal PWM_W for adjusting an active section of the backlight dimming signal PWM_I. The smoothing processor 218 outputs a smoothing image signal S_RGB, obtained by performing smoothing processing on the compensation image signal COMP_RGB, in response to the dimming range signal PWM_W. The data output part 220 outputs an image data signal DATA by adding the smoothing image signal S_RGB to the image signal RGB.

The control signal processor 230 outputs a first control signal CONT1 for driving of the data driver 126 shown in FIG. 1, and a second control signal CONT2 for driving the gate driver 124 shown in FIG. 1, in response to the control signal CTRL.

Figure 6:
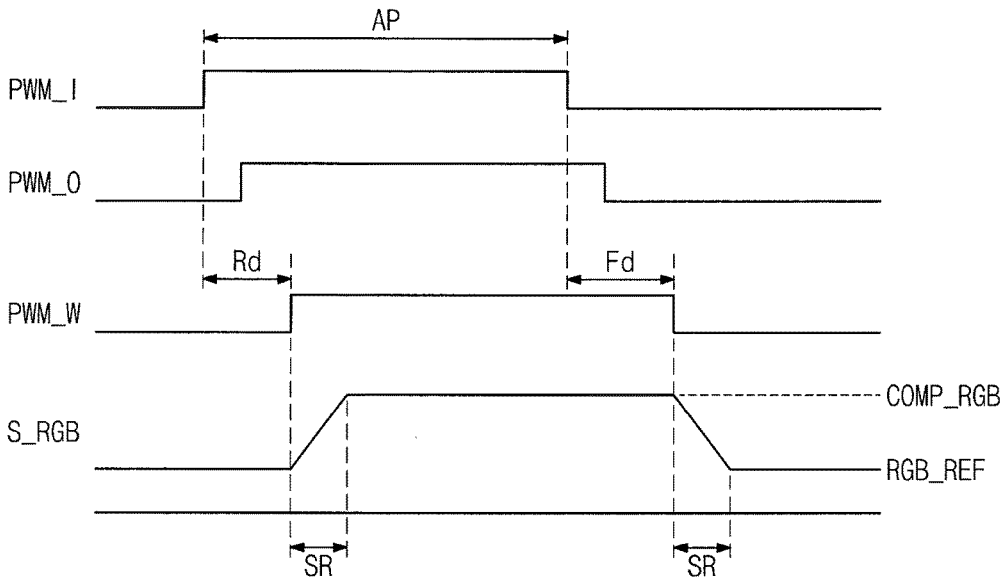
FIG. 6 is a timing diagram illustrating signals generated inside a timing controller shown in FIG. 5.

FIG. 6 is a timing diagram illustrating signals generated inside a timing controller shown in FIG. 5.

Referring to FIGS. 5 and 6, a backlight dimming signal PWM_I is a pulse signal including an active section AP that is maintained at a high level for a predetermined or set time. The global dimming block 212 delays the backlight dimming signal PWM_I by a predetermined or set time, and outputs a backlight control signal PWM_O. A delay time between the backlight dimming signal PWM_I and the backlight control signal PWM_O may be set in consideration of a delay time until an image data signal DATA is outputted from the compensator 214, the dimming range adjustor 216, the smoothing processor 218, and the data output part 220.

The compensator 214 includes a lookup table 215. The lookup table 215 stores a compensation image signal COMP_RGB corresponding to a grayscale value of the image signal RGB. The lookup table 215 may be configured with nonvolatile memory, such as ROM, EPROM, EEPROM, and/or flash memory.

FIG. 7 is a view illustrating a lookup table for the timing controller shown in FIG. 5.

Referring to FIG. 7, the lookup table 215 stores H compensation image values RGB_LUT respectively corresponding to G grayscale values from among G grayscale levels of the image signal RGB. Referring to FIG. 7, the lookup table 215 stores, for example, 12 compensation image signals COMP_RGB respectively corresponding to 12 grayscale values from among 1020 grayscale levels of the image signal RGB. Compensation ratios COMP1 to COMP10 respectively corresponding to the grayscale values of the image signal RGB may be set to a predetermined or set value.

Again, referring to FIGS. 5 and 6, the compensator 214 outputs the compensation image signal COMP_RGB corresponding to the image signal RGB by referring to the lookup table 215. When there is no grayscale value corresponding to the received image signal RGB in the lookup table 215, the compensator 214 may output the compensation image signal COMP_RGB by interpolation. For example, when a grayscale value of the received image signal RGB is 20, the compensation image signal COMP_RGB may be outputted by using a compensation image signal (16×COMP1) corresponding to 16 grayscale value and a compensation image signal (32×COMP1) corresponding to 32 grayscale value.

The dimming range adjustor 216 outputs a dimming range signal PWM_W for adjusting an active section of the backlight dimming signal PWM_I. As shown in FIG. 6, the dimming range adjustor 216 shifts the dimming range signal PWM_W into a high level at the timing delayed by a rising time Rd from the rising edge of the backlight dimming signal PWM_I, and shifts the dimming range signal PWM_W into a low level at the timing delayed by a falling delay time Fd from the falling edge of the backlight dimming signal PWM_I. The rising delay time Rd and the falling delay time Fd may be set in consideration of a delay time on a path that the backlight control signal PWM_O outputted from the timing controller 122 shown in FIG. 1 is delivered to the backlight unit 130 via signal wiring. The rising delay time Rd and the falling delay time Fd may be set to be identical or substantially identical to each other, or may be set to be different from each other.

The smoothing processor 218 performs smoothing processing on the compensation image signal COMP_RGB in synchronization with the dimming range signal PWM_W. Such smoothing processing is to prevent or substantially prevent the image data signal DATA from drastically changing from the image signal RGB into the compensation image signal COMP_RGB. That is, the smoothing processor 218 outputs a smoothing image signal S_RGB to change (e.g., gradually change or change with a 45 degree slope) from a reference level RGB_REF into a level of the compensation image signal COMP_RGB during a smoothing section SR from the rising edge of the dimming range signal PWM_W. The reference level RGB_REF may be set to be a level that is lower by a predetermined or set value than that of the compensation image signal COMP_RGB.

The data output part 220 outputs an image data signal DATA by adding the smoothing image signal S_RGB to the image signal RGB. The image data signal DATA is a signal compensated in synchronization with the backlight dimming signal PWM_I.

When the backlight unit 130 shown in FIG. 1 is turned on, as characteristics of a thin film transistor TR are changed by the light emitted to the display panel 110, leakage current flows so that the luminance of the display panel 110 is deteriorated. The luminance deterioration of the display panel 110 may be compensated by an image data signal DATA that is outputted by adding the smoothing image signal S_RGB to the image signal RGB. Therefore, waterfall noise occurring when the backlight unit 130 is dimming-driven through a PWM method may be reduced. Therefore, the display quality of a display device may be improved.

Figure 8:
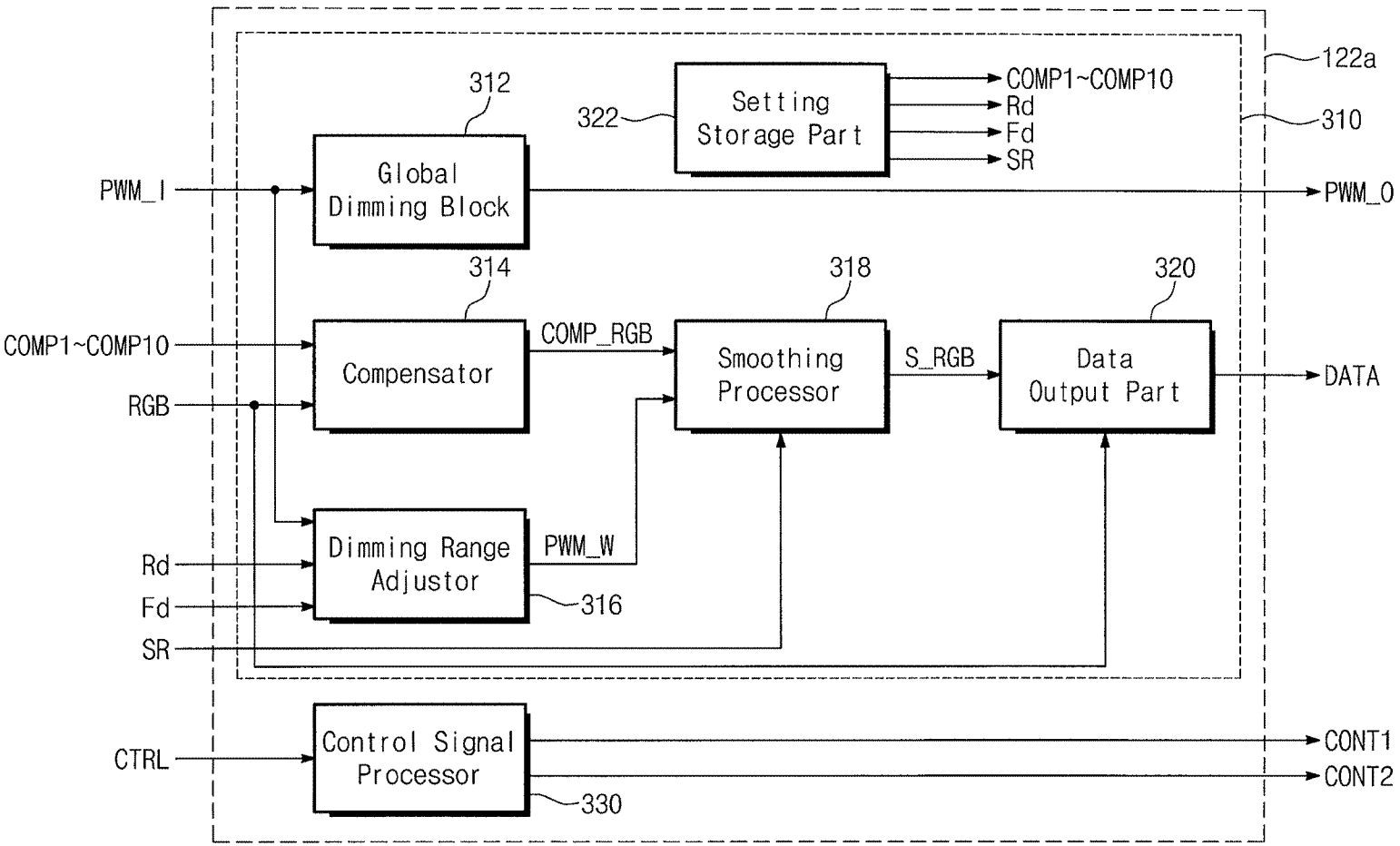
FIG. 8 is a block diagram illustrating a configuration of a timing controller shown in FIG. 1 according to another exemplary embodiment of the invention.

FIG. 8 is a block diagram illustrating a configuration of a timing controller shown in FIG. 1 according to another embodiment of the invention.

Referring to FIG. 8, a timing controller 122*a* includes a backlight control part 310 and a control signal processor 330. The backlight control part 310 includes a global dimming block 312, a compensator 314, a dimming range adjustor 316, a smoothing processor 318, a data output part 320, and a setting storage part 322.

The global dimming block 312 receives a backlight dimming signal PWM_I provided from the outside, and outputs the backlight control signal PWM_O. The backlight control signal PWM_O may have the same or substantially the same pulse width as that of the backlight dimming signal PWM_I, and may be a signal for delaying the backlight dimming signal PWM_I by a predetermined or set time.

The compensator 314 receives an image signal RGB and compensation ratios COMP1 to COMP10, and outputs a compensation image signal COMP_RGB. The compensation ratios COMP1 to COMP10 respectively correspond to grayscale values of the image signal RGB of the lookup table 215 shown in FIG. 7. The compensation ratios COMP1 to COMP10 respectively corresponding to the grayscale values of the image signal RGB may be set to a predetermined or set value, or a value stored in the setting storage part 322.

The dimming range adjustor 316 receives a backlight dimming signal PWM_I, a rising delay time Rd, and a falling delay time Fd, and outputs a dimming range signal PWM_W for adjusting an active section of the backlight dimming signal PWM_I. The rising delay time Rd is a time until the dimming range signal PWM_W shifts into a high level from the rising edge of the backlight dimming signal PWM_I shown in FIG. 6. The falling delay time Fd is a time until the dimming range signal PWM_W shifts into a low level from the falling edge of the backlight dimming signal PWM_I shown in FIG. 6.

After the rising delay time Rd elapses from the rising edge of the backlight dimming signal PWM_I, the dimming range adjustor 316 shifts the dimming range signal PWM_W into a high level, and after the falling delay time Fd elapses from the falling edge of the backlight dimming signal PWM_I, the dimming range adjustor 316 shifts the dimming range signal PWMW into a low level.

The smoothing processor 318 outputs a smoothing image signal S_RGB, obtained by performing smoothing processing on the compensation image signal COMP_RGB, in response to the dimming range signal PWM_W and the smoothing section SR. After the dimming range signal PWM_W is shifted into a high level, the smoothing processor 318, as shown in FIG. 6, outputs the smoothing image signal S_RGB to change (e.g., gradually change or change with a 45 degree slope) from a reference level RGB_REF into a level of the compensation image signal COMP_RGB during a smoothing section SR. Additionally, after the dimming range signal PWM_W is shifted into a low level, the smoothing processor 318 outputs a smoothing image signal S_RGB to change (e.g., gradually change or change with a 45 degree slope) from a level of the compensation image signal COMP_RGB into a reference level RGB_REF during a smoothing section SR.

The data output part 320 outputs an image data signal DATA by adding the smoothing image signal S_RGB to the image signal RGB.

The setting storage part 322 stores compensation ratios COMP1 to COMP10 to be provided to the compensator 314, a rising delay time Rd and a falling delay time Fd to be provided to the dimming range adjustor 316, and a smoothing section SR to be provided to the smoothing processor 318.

The control signal processor 330 outputs a first control signal CONT1 for driving of the data driver 126 shown in FIG. 1, and a second control signal CONT2 for driving the gate driver 124 shown in FIG. 1, in response to the control signal CTRL.

A timing controller having such a configuration compensates an image data signal in order to adjust the luminance of a display image in synchronization with a backlight dimming signal. Therefore, waterfall noise occurring when a backlight unit is dimming-driven through a PWM method may be reduced. Therefore, the display quality of a display device may be improved.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The above-disclosed embodiments are to be considered illustrative and not restrictive, and the appended claims and their equivalents are intended to cover all such modifications, enhancements, and other embodiments, which fall within the spirit and scope of the invention. Thus, to the maximum extent allowed by law, the scope of the invention is to be determined by the broadest permissible interpretation of the following claims and their equivalents, and shall not be restricted or limited by the foregoing detailed description.

What is claimed is:

1. A timing controller comprising:

a compensator configured to receive an image signal and to output a compensation image signal;

a dimming range adjustor configured to receive a backlight dimming signal and to output a dimming range signal to adjust an active section of the backlight dimming signal;

a smoothing processor configured to output a smoothing image signal to smooth the compensation image signal in response to the dimming range signal; and a data output part configured to output an image data signal by adding the smoothing image signal to the image signal.

2. The timing controller of claim 1, wherein the compensator comprises a lookup table to store the compensation image signal corresponding to a grayscale value of the image signal.

3. The timing controller of claim 2, wherein the image signal corresponds to one of G grayscale values;

the lookup table stores H compensation image signals respectively corresponding to the G grayscale values of the image signal; and the compensator is configured to interpolate the H compensation image signals to output the compensation image signal corresponding to the image signal (where G and H are positive integers, respectively (G>H)).

4. The timing controller of claim 3, further comprising a global dimming block configured to output a backlight control signal by delaying the backlight dimming signal by a time.

5. The timing controller of claim 4, wherein the compensator is configured to output the compensation image signal corresponding to the grayscale value of the image signal by referring to the lookup table, and to compensate the compensation image signal in response to a compensation level signal.

6. The timing controller of claim 5, wherein the dimming range adjustor is configured to output the dimming range signal by adjusting the active section of the backlight dimming signal in response to a rising delay setting signal and a falling delay setting signal.

7. A display device comprising:

a display panel comprising a plurality of pixels respectively connected to a plurality of gate lines and a plurality of data lines;

a gate driver configured to drive the plurality of gate lines;

a data driver configured to drive the plurality of data lines in response to an image data signal;

a backlight configured to supply light to the display panel in response to a backlight control signal; and a timing controller configured to receive an image signal, a control signal, and a backlight dimming signal, and to provide the image data signal to the data driver and the backlight control signal to the backlight, wherein the timing controller is configured to provide the image data signal to the data driver by compensating the image signal received during an active section of the backlight control signal, and wherein the timing controller comprises:

a compensator configured to receive the image signal and to output a compensation image signal;

a dimming range adjustor configured to receive the backlight dimming signal and to output a dimming range signal to adjust an active section of the backlight dimming signal;

a smoothing processor configured to output a smoothing image signal to smooth the compensation image signal in response to the dimming range signal; and a data output part configured to output the image data signal by adding the smoothing image signal to the image signal.

8. The display device of claim 7, wherein the timing controller is configured to provide the image data signal to the data driver by compensating the image signal received during a rising section and a falling section of the backlight control signal.

9. The display device of claim 7, wherein the compensator comprises a lookup table to store the compensation image signal corresponding to a grayscale value of the image signal.

10. The display device of claim 9, wherein the image signal corresponds to one of G grayscale values;

the lookup table stores H compensation image signals respectively corresponding to the G grayscale values of the image signal; and the compensator is configured to interpolate the H compensation image signals to output the compensation image signal corresponding to the image signal (where G and H are positive integers, respectively (G>H)).

11. The display device of claim 10, wherein the timing controller comprises a global dimming block configured to output the backlight control signal by delaying the backlight dimming signal by a time.

12. The display device of claim 11, wherein the compensator is configured to output the compensation image signal corresponding to the grayscale value of the image signal by referring to the lookup table, and to compensate the compensation image signal in response to a compensation level signal.

13. The display device of claim 12, wherein the dimming range adjustor is configured to output the dimming range signal by adjusting the active section of the backlight dimming signal in response to a rising delay setting signal and a falling delay setting signal.

14. The display device of claim 13, wherein the smoothing processor is configured to output the smoothing image signal by smoothing the compensation image signal during a rising section and a falling section of the dimming range signal in response to a smoothing section setting signal.

15. The display device of claim 14, wherein the timing controller further comprises a setting storage part configured to store the compensation level signal, the rising delay setting signal, the falling delay setting signal, and the smoothing section setting signal.

16. The display device of claim 7, wherein the timing controller further comprises a control signal processor configured to output a first control signal to drive the data driver and a second control signal to drive the gate driver in response to the control signal.

* * * * *